US005803359A

United States Patent [19]

Vandoninck

[11] Patent Number: 5,803,359

[45] Date of Patent: Sep. 8, 1998

[54] DEVICE FOR GENERATING A FOG

[75] Inventor: Alfons Vandoninck, Deurne, Belgium

[73] Assignee: Jaico, Opglabeek, Belgium

[21] Appl. No.: 648,189

[22] PCT Filed: Nov. 24, 1994

[86] PCT No.: PCT/BE94/00090

§ 371 Date: Jul. 3, 1996

§ 102(e) Date: Jul. 3, 1996

[87] PCT Pub. No.: WO95/14981

PCT Pub. Date: Jun. 1, 1995

[30] Foreign Application Priority Data

Nov. 24, 1993 [BE] Belgium ..... 09301293

[51] Int. Cl.[6] ..... H05B 3/48; G08B 15/02

[52] U.S. Cl. ..... 239/2.1; 239/14.1; 239/136

[58] Field of Search ..... 239/2.1, 14.1, 239/128, 135, 136; 392/402, 403

[56] References Cited

U.S. PATENT DOCUMENTS

| | | | |
|---|---|---|---|
| 2,311,199 | 2/1943 | Astradsson | 392/402 X |
| 3,864,440 | 2/1975 | Giocoechea | 392/403 X |
| 4,129,252 | 12/1978 | Pouring | 239/14.1 X |
| 4,697,735 | 10/1987 | Temple | 392/402 X |
| 4,764,660 | 8/1988 | Swiatosz . | |
| 4,818,843 | 4/1989 | Swiatosz . | |
| 5,156,333 | 10/1992 | Worsfold | 239/2.1 |

FOREIGN PATENT DOCUMENTS

| | | | |
|---|---|---|---|
| 708729 | 4/1930 | France | 392/403 |
| A2501960 | 9/1982 | France . | |
| A2161378 | 6/1973 | Germany . | |
| 15823 | 9/1992 | WIPO | 392/403 |

*Primary Examiner*—Kevin Weldon

*Attorney, Agent, or Firm*—Birch, Stewart, Kolasch & Birch, LLP

[57] ABSTRACT

The invention relates to a device for generating a fog, characterized in that it comprises: a) a first closed vessel (1) kept at temperature and filled with a mixture having such a vapor pressure curve that pressure can be generated by varying the temperature of the mixture; b) a second closed vessel (2, 2', 2") with a heat exchanger kept at a higher temperature; c) a pipe (7) with a valve (8) connecting the mixture from the first vessel to the second vessel (2, 2', 2"); d) an outlet (16, 16') in the wall of the second vessel (2, 2', 2") for distributing the fog generated under pressure in this latter vessel into the environment.

20 Claims, 3 Drawing Sheets

DEVICE FOR GENERATING A FOG

BACKGROUND OF THE INVENTION

1. Field of the Invention

This invention relates to a device for generating a fog.

The object of the invention is to provide a device which can gasify a relatively small quantity of liquid extremely quickly, in order to fill a closed space entirely or almost entirely.

The invention intends in particular to provide a device, by means of which a quantity of non-transparent vapour can be generated in a space starting from a signal emitted by an alarm device so that, in case of burglary, the burglar is in a room where any visual observation or orientation has become impossible.

2. Description of the Background Art

The use of a fog, filling one or more spaces, as means for preventing burglaries is suggested by German patent No. DE-A-21 61 378. This document gives no indication of the way wherein large quantities of fog can be generated quickly. This is indeed an absolute requirement to apply this method with success.

French patent 2 501 960 describes a method and a device for generating an artificial fog, wherein water has to be preheated for transferring thermal energy to the liquid or frozen $CO_2$ in order to vaporize this $CO_2$ into the vapour phase. This transfer occurs in a subsequent mixing room or mixing and storage room.

The thermal energy used here is therefore not used to exert a sufficient pressure for permitting the artificial fog to be emitted quickly.

SUMMARY OF THE INVENTION

An essential object of the invention is thus to generate large quantities of fog and to distribute it by using the pressure, which can be continuously generated by a small quantity of liquid during a known and determined period.

To achieve this object, the device according to the invention comprises:

a) a first closed vessel kept at a first temperature and filled with an alcohol mixture, a second closed vessel having a heat exchanger therein for keeping the second vessel at a second temperature higher than the first temperature of the first vessel, a pipe connecting the first vessel to the inside of the second vessel, said pipe including a valve mounted thereon between the first vessel and the second vessel and opening a connection between the first vessel and the second vessel upon activation by a signal emitted by an alarm device, and an outlet located in the wall of the second vessel for distributing fog generated under pressure in the second vessel into the environment with a mixture consisting of mono- or polyvalent alcohols and a liquid and/or a gas or a mixture of liquids or gasses having such a vapour pressure curve that pressure can be generated by varying the temperature of the mixture;

b) a second closed vessel with a heat exchanger kept at a temperature higher than the temperature of the liquids and/or gasses in the first vessel;

c) a pipe connecting the liquid or the liquid mixture from the first vessel to the inside of the second vessel, said pipe comprising a valve mounted thereon between the first and the second vessel and opening the connection between the first and the second vessel upon activation by a signal emitted by an alarm device;

d) an outlet in the wall of the second vessel for distributing the fog generated in this latter vessel into the environment, optionally by using a pipe mounted on this outlet.

Still according to the invention, the first and second vessels are kept at the required temperature by thermostatically controlled heating resistances, and the heat exchanger is formed by a mass kept at the required temperature, onto which mass the alcohol mixture coming from the first vessel can be evaporated and/or overheated.

In a preferably applied embodiment, the mass of metal particles (die-waste).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other details and advantages of the invention will become apparent from the following description of a device for generating a fog, according to the invention. This description is only given by way of example and does not limit the invention. The reference numerals relate to the figures annexed hereto.

DETAILED DESCRIPTION OF THE DRAWINGS

The device represented by these three figures, includes the combination or juxtaposition of two vessels called hereinafter the first vessel 1 and the second vessel 2, 2' or 2". Preference is given to a cylindrical embodiment, but it is clear that one of the vessels 1 and 2 or both vessels may show any cross section.

Figure 1:
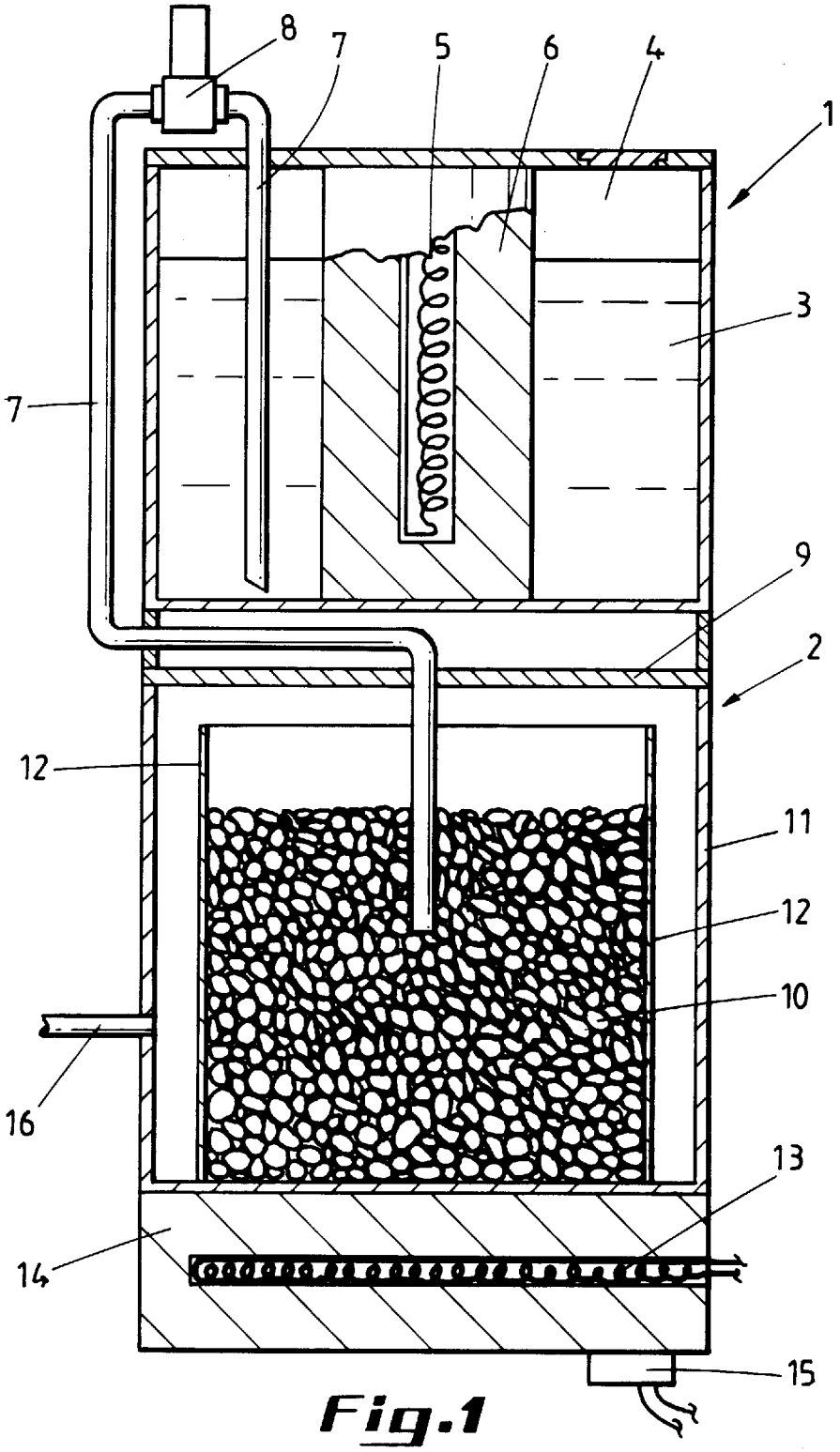
FIG. 1 is, according to a longitudinal cross section, a schematic view of the device according to the invention in a first embodiment.
Figure 2:
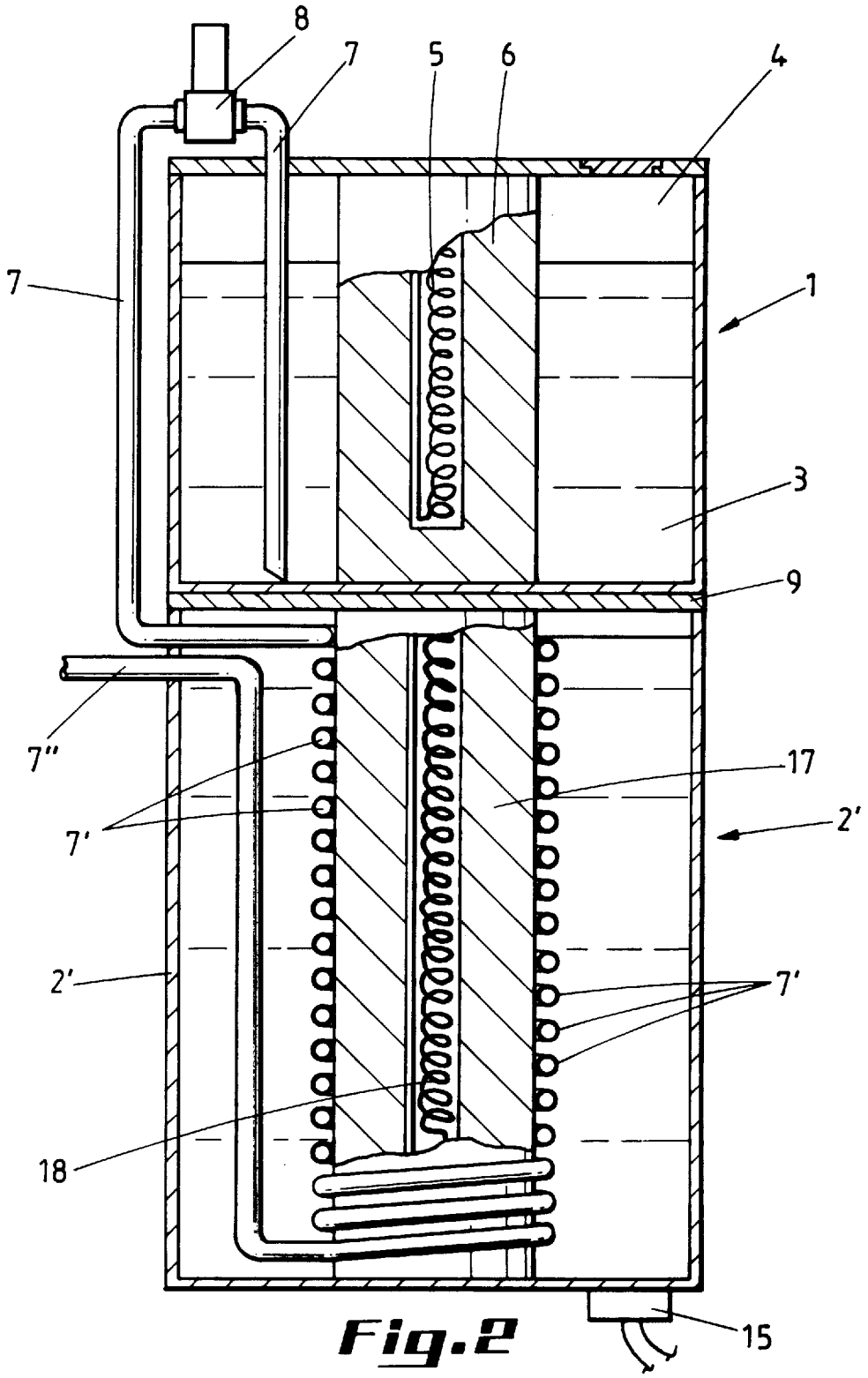
FIG. 2 is a similar view of a device according to a possible variant.

In the embodiments according to FIGS. 1 and 2, the first vessel 1 is partially filled with a glycol mixture and water indicated with reference 3.

For the same purpose, use can be made of a mixture of several mono- or polyvalent alcohols and a liquid and/or a gas (or a mixture of liquids and/or gasses) having such a vapour pressure curve that the pressure in the space 4 above the liquid can be generated by varying the temperature of the mixture.

Preferably, use is made of a mixture consisting of about 48% propylene glycol, about 32% triethylene glycol and about 20% water.

Certain alcohols apparently generate a "fog" by heating them up to above their respective boiling points. This property was especially observed in case of bivalent alcohols, the so-called glycols or diols. The best known representatives of this group are: propylene glycol, ethylene glycol, diethylene glycol and triethylene glycol. Diols with a relatively high molecular weight, such as triethylene glycol, have a relatively high boiling point and generate a rather "heavy fog" clinging at a low level.

Diols with a relatively low molecular weight, such as propylene glycol, have a relatively low boiling point and generate a rather "light fog" having the tendency to rise.

By mutually combining the different types of diols, the structure of the formed fog can be influenced as to space filling properties.

Other mono-, bi-, tri- or polyvalent alcohols or mixtures of these alcohols could cause the same effect.

In the vessel 1 (according to both embodiments), a heating resistance 5 is mounted surrounded by a distribution bar 6, for example, of aluminium. This forms a cylindrical part situated in the middle of the vessel 1. The temperature in this vessel is in the order of magnitude of 125°–150° C.

In the mixture of said liquids and/or gasses, a pipe 7 is placed, having a valve 8 mounted thereon. The valve 8 is activated by a signal, emitted by an alarm device reacting in case of burglary. This alarm device is not represented in the figures.

The pipe 7 runs out of the vessel 1 downwards and penetrates into the vessel 2. From now on, there are thus at least three possible embodiments, which will be described hereinafter with reference to the FIGS. 1, 2 and 3.

In the embodiment according to FIG. 1, the pipe 7 enters at the top in the middle of the cover 9 and extends down to about the middle of the grit mass 10 enclosed in the vessel 2. The grit mass 10 does not touch the outer wall 11 of the vessel 2 but is enclosed in an inner pipe 12.

Figure 3:
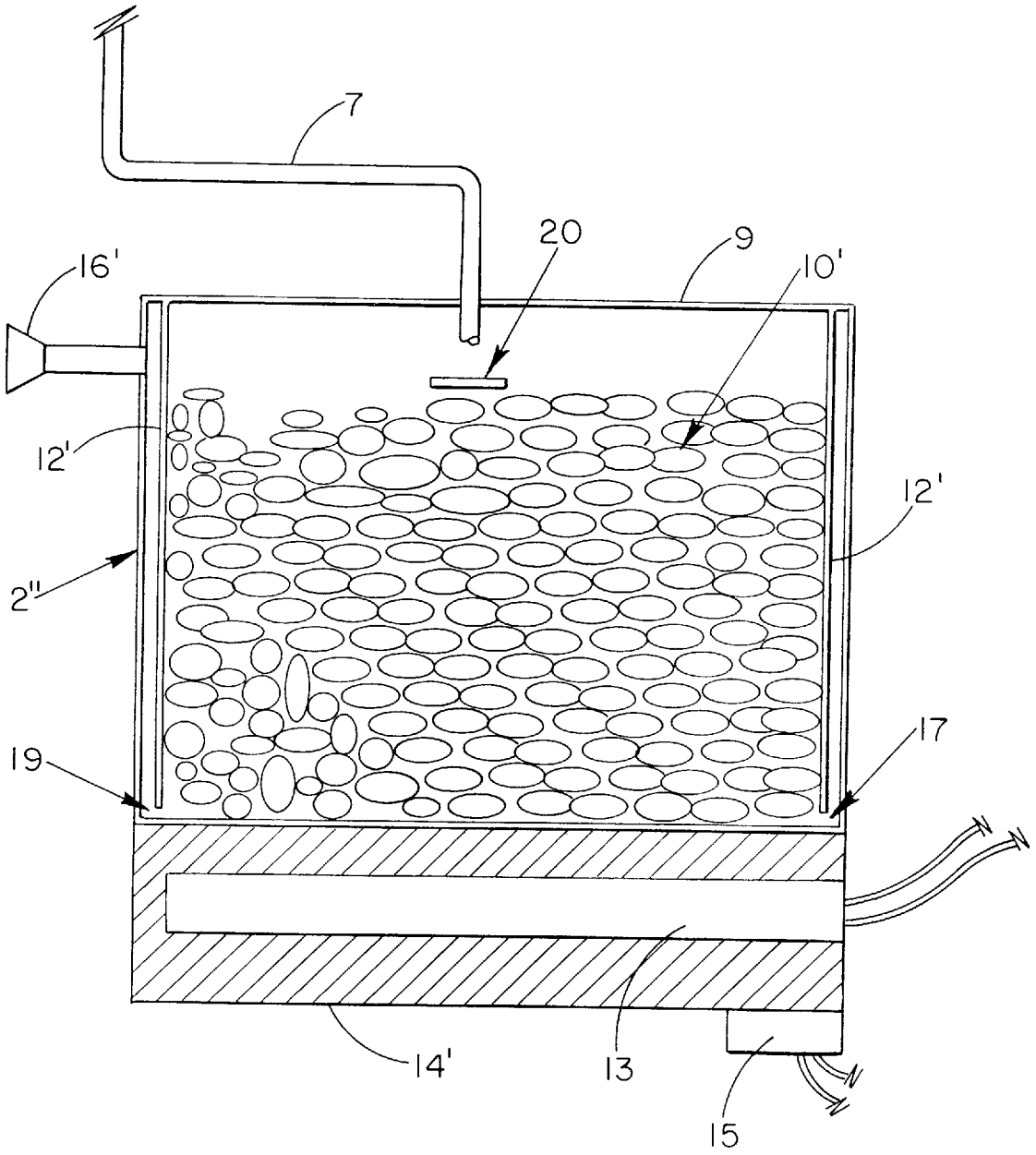
FIG. 3 is a similar view of the second vessel from a device according to a second variant.

Instead of a grit mass use can be made of metal particles 10' as shown by FIG. 3.

The grit mass 10 (FIG. 1) or the metal particles 10' (FIG. 3) are brought at a high temperature by the electrical resistance 13 located in the bottom plate 14. This temperature is in the order of magnitude of 320° C. The bottom plate 14 is made of a material having a high heat storage capacity. The temperature of the bottom plate 14 is kept at a constant level thanks to the thermostat 15 which is in contact with this bottom plate or which is mounted therein.

The role of the bottom plate 14 with heating resistance 15 in the embodiments described herein can be taken over by elements provided to perform the same function. It is, for example, possible to design the vessel 2 in such a way that at least a part thereof is made of a material and/or has a mass with a high heat storage capacity. The heating resistance could then be mounted in the wall or on another place in the mass.

The vapours generated in the vessel 2 or 2" leave these vessels through an outlet 16 or 16'. If necessary, a pipe which is not shown in the figures can be mounted on these outlets 16, 16'. This allows to mount or to incorporate the device at a place which is not necessarily in the space which is to be protected.

Referring now to the embodiment according to FIG. 2, it will be noticed that the first vessel, 1, shows the same structure.

The pipe 7, penetrating into the vessel 2', is wound spirally around a distribution bar 17 bathed in a thermo-oil. This distribution bar, which may be made of aluminum, comprises a heating resistance 18. The spiral windings of the pipe 7 around the distribution bar 17 are indicated with reference 7'.

At the bottom of the distribution bar 17, the last spiral winding of the pipe 7' is converted in a pipe 7" through which the generated fog escapes. With respect to the embodiment according to FIG. 3, it will be noticed that the inner pipe 12' is connected at the top to the part which can be considered as the cover 9 of the second vessel. At the bottom, a passage 19 is maintained between the edge of the inner pipe 12' and the bottom plate 14'.

Thanks to this structure, a better and stronger distribution of the fog is ensured.

It will be noticed that the mixture leaving the pipe 7, in the vessel 2", is spread out over the metal particles 10' by a distribution plate 20.

This further increases the power with which the mixture is forced out of the vessel 2 through the outlet 16'.

The device according to the invention offers thus a number of advantages which are set forth hereinafter, such as:

Exceptional compact construction;

No moving parts at all. The device comprises only one valve;

The required mixture, usually a glycol mixture, is filled up via an ordinary filling stopper—further actions are not required;

Because of the cylindrical construction, the device can be easily insulated and has a very advantageous volume/surface ratio;

In case of a power failure (220 Volt) the inner temperature and the heat capacity remain many hours at a high level, depending on the reliability of the insulation, and anyway high enough to guarantee nevertheless the operation of the device upon application of the 12 V control signal to the valve;

Very simple construction with a high operational reliability;

The glycol or the glycol mixture is brought automatically under pressure without using pumps and/or pressure storage reservoirs;

The pressure on the glycol mixture (or similar mixture) is rather constant. This results in a constant evaporation independent of the glycol volume;

A relatively small heat exchanger may be sufficient because the liquid is already preheated when supplied to this heat exchanger.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. A device for generating a fog, comprising:

a first closed vessel kept at a first temperature and filled with an alcohol mixture;

a second closed vessel having a heat exchanger therein for keeping the second vessel at a second temperature higher than the first temperature of the first vessel;

a pipe connecting the first vessel to the inside of the second vessel, said pipe including a valve mounted thereon between the first vessel and the second vessel and opening a connection between the first vessel and the second vessel upon activation by a signal emitted by an alarm device; and an outlet located in the wall of the second vessel for distributing fog generated under pressure in the second vessel into the environment.

2. The device according to claim 1, wherein said alcohol mixture is composed of about 48% propylene glycol, about 32% triethylene glycol and about 20% water.

3. The device according to claim 1, wherein said first and second vessels are kept at the required temperature by thermostatically controlled heating resistances.

4. The device according to claim 1, wherein said heat exchanger is formed by a mass kept at the required temperature, onto which the alcohol mixture coming from the first vessel can be evaporated and/or overheated.

5. The device according to claim 4, wherein said mass comprises metal particles.

6. The device according to claim 4, wherein said mass comprises a grit.

7. The device according to claim 1, wherein said second vessel is equipped with a body kept at temperature by a heating resistance, said pipe coming from the first vessel being wound around this body and debouching further out of the second vessel, the space between said body and the wall of the second vessel being filled with a thermo-oil.

8. The device according to claim 1, wherein said second vessel is made at least partially of a material with a high heat storage capacity, which material is kept at temperature by a heating element.

9. The device according to claim 2, wherein said second vessel is equipped with a body kept at temperature by a heating resistance, said pipe coming from the first vessel being wound around this body and debouching further out of the second vessel, the space between said body and the wall of the second vessel being filled with a thermo-oil.

10. A fog generating device comprising a first closed vessel containing an alcohol mixture for generating a fog, which first vessel is connected to a second vessel equipped with a heat exchanger and means for heating said heat exchanger to a second temperature for evaporating said alcohol mixture so as to generate said fog and an outlet for expelling said fog under pressure, which device further comprises means for driving said alcohol mixture to flow from said first to said second vessel, wherein said first vessel comprises means for heating the vessel to a first temperature below said second temperature, and said means for driving said alcohol mixture comprise a vapor generating liquid which evaporates at said first temperature, so as to generate a pressure for driving said alcohol mixture.

11. The fog generating device as claimed in claim 10, wherein said first vessel is connected to said second vessel by means of a pipe comprising a valve, which valve is arranged to be opened upon activation by a signal emitted by an alarm device.

12. The fog generating device as claimed in claim 10, wherein said first vessel contains a mixture composed of about 48% propylene glycol, about 32% triethylene glycol and about 20% of water.

13. The fog generating device as claimed in claim 10, wherein said first and second vessels are kept at the required temperature by thermostatically controlled heating resistances.

14. The fog generating device as claimed in claim 10, wherein said heat exchanger comprises a heating mass.

15. The fog generating device as claimed in claim 14, wherein said heating mass comprises metal particles.

16. The fog generating device as claimed in claim 14, wherein said heating mass comprises grit.

17. The fog generating device as claimed in claim 11, wherein said second vessel comprises a body and a heating resistance for heating said body, whereby said pipe is wound around said body and debauches further out of said second vessel, whereby space is left between said body and the wall of said second vessel, which space is filled with a thermo-oil.

18. The fog generating device as claimed in claim 10, wherein said second vessel is at least partially made of a heat isolating material, which second vessel comprises a heating element for heating said material.

19. The fog generating device as claimed in claim 10, wherein said second vessel comprises an amount of a material with a high heat storage capacity, which second vessel comprises a heating element for heating said material.

20. A method for generating fog, wherein a mixture of alcohols and a liquid contained in a pressurized vessel is heated to a first temperature so as to evaporate said liquid and to force said alcohols to flow to a heat exchanger at a second temperature above said first temperature for evaporating said alcohols to generate an alcohol vapor, whereafter vapor is expelled from said heat exchanger to give fog.

* * * * *